US006764592B1

(12) United States Patent
Ganji

(10) Patent No.: US 6,764,592 B1
(45) Date of Patent: Jul. 20, 2004

(54) DRUM WARMING IN PETROLEUM COKERS

(76) Inventor: Kazem Ganji, 4008 Nailon Dr., Norman, OK (US) 73072

( * ) Notice: Subject to any disclaimer, the term of this patent is extended or adjusted under 35 U.S.C. 154(b) by 386 days.

(21) Appl. No.: 09/949,185

(22) Filed: Sep. 7, 2001

(51) Int. Cl.[7] ..... C10G 9/00
(52) U.S. Cl. ..... 208/131; 202/96
(58) Field of Search ..... 208/131; 202/96

(56) References Cited

U.S. PATENT DOCUMENTS

| | | | | |
|---|---|---|---|---|
| 1,729,307 A | | 9/1929 | Dubbs | |
| 2,072,524 A | | 3/1937 | Mace | |
| 2,093,588 A | | 9/1937 | Forward | |
| 2,132,639 A | | 10/1938 | Morrell | |
| 3,917,564 A | | 11/1975 | Meyers | |
| 4,176,052 A | | 11/1979 | Bruce et al. | |
| 4,404,092 A | | 9/1983 | Audeh et al. | |
| 4,443,328 A | | 4/1984 | Sakurai | |
| 4,501,654 A | | 2/1985 | Allan | |
| 4,521,277 A | | 6/1985 | Calderon et al. | |
| 4,612,109 A | | 9/1986 | Dillon et al. | |
| 4,666,585 A | | 5/1987 | Figgins et al. | |
| 4,874,505 A | | 10/1989 | Bartilinecci et al. | |
| 4,919,843 A | | 4/1990 | Innertsberger et al. | |
| 4,961,840 A | | 10/1990 | Goyal | |
| 4,968,407 A | | 11/1990 | McGrath et al. | |
| 4,969,988 A | | 11/1990 | Jain et al. | |
| 4,994,169 A | | 2/1991 | Godino et al. | |
| 5,024,730 A | * | 6/1991 | Colvert | 196/132 |
| 5,068,024 A | | 11/1991 | Moretta et al. | |
| 5,169,560 A | | 12/1992 | Hart | |
| 5,296,132 A | | 3/1994 | Hart | |
| 5,389,234 A | | 2/1995 | Bhargava et al. | |
| 5,389,299 A | | 2/1995 | Hart | |
| 5,439,489 A | | 8/1995 | Scalliet et al. | |
| 5,443,717 A | | 8/1995 | Scalliet et al. | |
| 5,667,669 A | | 9/1997 | Hart | |
| 5,891,310 A | * | 4/1999 | Nelsen | 201/10 |
| 6,117,308 A | | 9/2000 | Ganji | |

FOREIGN PATENT DOCUMENTS

| | | | | |
|---|---|---|---|---|
| SU | 1279997 A | * | 12/1986 | C10B/55/00 |

* cited by examiner

*Primary Examiner*—Walter D. Griffin
(74) *Attorney, Agent, or Firm*—Fellers, Snider, Blankenship, Bailey & Tippens, P.C.

(57) ABSTRACT

A method of producing petroleum coke in a petroleum coking system comprising the steps of (a) adding a fluid to a live coking drum while warming a second drum so that additional vapor is provided in the live drum and (b) reducing pressure loss in the live drum by regulating the addition of the fluid based upon a target pressure for the live drum and by regulating the flow of warm-up vapor from the live drum to the second drum based upon a target pressure for the second drum. The flow of warm-up vapor from the live drum to the second drum is preferably conducted via a conduit system having a total length of less than 100 feet.

20 Claims, 1 Drawing Sheet

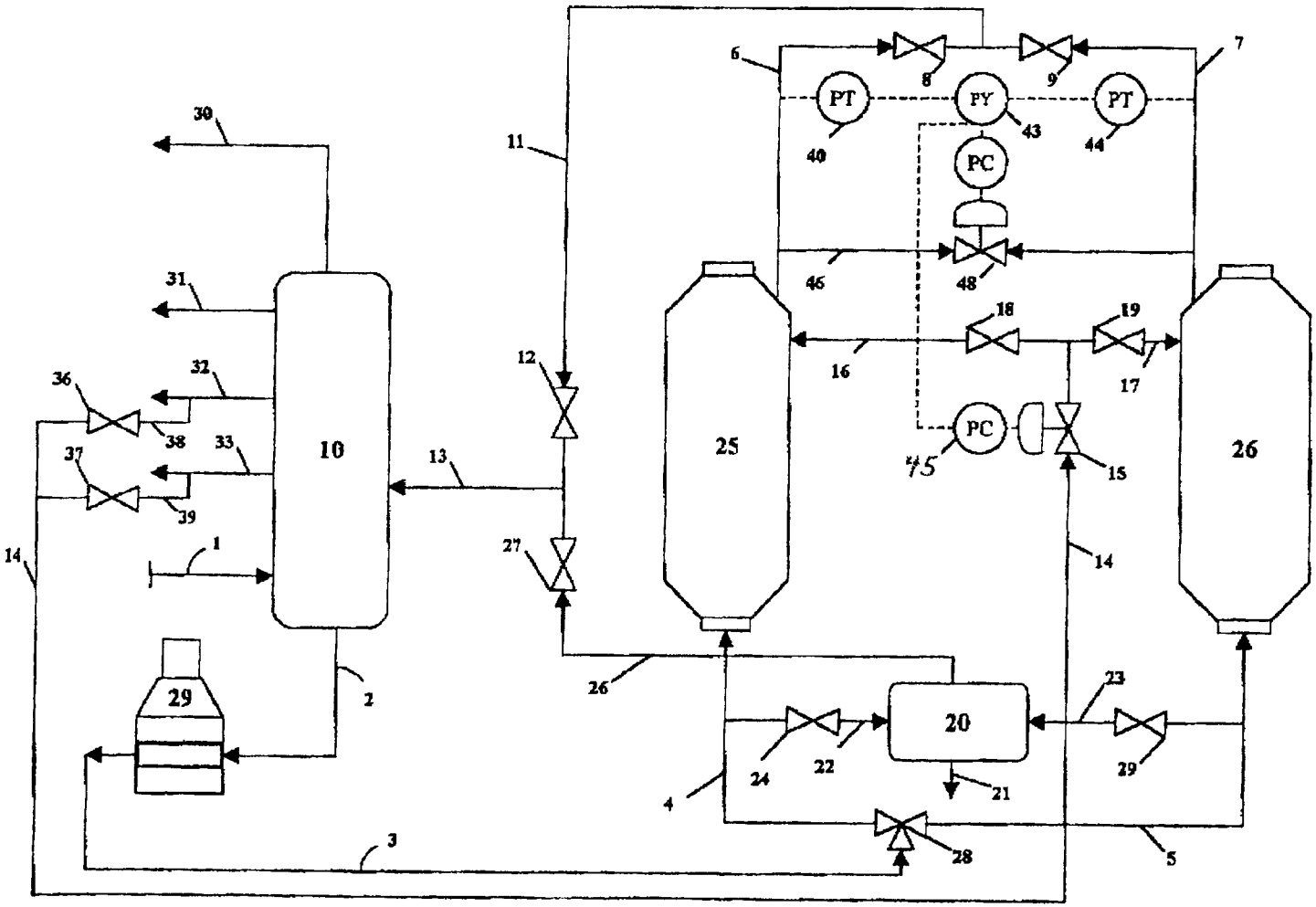
PT
PY
PC
PC
PT
10
20
25
26
29

DRUM WARMING IN PETROLEUM COKERS

FIELD OF THE INVENTION

The present invention relates to methods of and apparatuses for warming coking drums in petroleum coking systems.

BACKGROUND OF THE INVENTION

Coking systems are commonly used in petroleum refineries for converting vacuum tower bottoms and/or other heavy (i.e., high boiling point) residual petroleum materials to petroleum coke and other products. The greater part of each barrel of resid material processed in the coker will typically be recovered as fuel gas, coker gasoline/naphtha, light cycle oil (also commonly referred to by various other names such as light coker gas oil), and heavy cycle oil (also commonly referred to by various other names such as heavy coker gas oil).

A typical delayed coking system comprises: a combination tower or other fractionator; a fired heater; and at least one vertical coking drum. Most coking systems include at least a pair of vertical coking drums. The heavy coker feed is typically delivered to the bottom of the fractionator wherein it is combined with a heavy, liquid, residual bottom product (commonly referred to as a "recycle") produced in the fractionator. The resulting mixture is drawn from the bottom of the fractionator and then pumped through the heater and into at least one coking drum. Typically, multiple coking drums are operated in alternating cycles such that, while one drum (referred to herein as the "live" drum) is -operating in a fill cycle, another drum is operating in a second cycle typically comprising a steaming stage, a cooling/quenching stage, a hydraulic decoking stage, a pressure testing stage, and a warm-up stage. During the warm-up stage, a portion of the product vapor produced in the live drum is used to warm the empty drum.

In the fill cycle, the hot feed material from the coker heater typically flows into the bottom of the live coking drum. Some of the heavy feed material vaporizes in the heater such that the material entering the bottom of the coking drum is a vapor/liquid mixture. The vapor portion of the mixture undergoes mild cracking in the coking heater and experiences further cracking as it passes upwardly through the coking drum. The hot liquid material undergoes intensive thermal cracking and polymerization in the coking drum such that the liquid material is converted to cracked vapor and petroleum coke. The resulting combined overhead vapor product produced in the coking drum is typically delivered to the fractionator wherein it is separated into gas, naphtha, light cycle oil, and heavy cycle oil, which are withdrawn from the fractionator as products, and the heavy recycle/residual material which flows to the bottom of the fractionator. The light and heavy cycle oil products are typically taken from the fractionator as side-draw products which are further processed (e.g., in a fluid catalytic cracker) to produce gasoline and other desirable end products. The heavy recycle material combines with the heavy feed material in the bottom of the fractionator and, as mentioned above, is pumped with the heavy feed material through the coker heater.

By way of example, but not by way of limitation, typical coker operating conditions and product specifications include: a heater outlet temperature in the range of from about 905 to about 935° F.; coke drum pressures in the range of from about 20 to about 40 psig; live drum overhead temperatures in the range of from about 800° to about 820° F.; a fractionator overhead pressure in the range of from about 10 to about 30 psig; a fractionator bottom temperature in the range of from about 750° to about 780° F.; a light cycle oil draw temperature in the range of from about 450° to about 550° F.; a light cycle oil initial boiling point (ASTM D-1186) in the range of from about 300° to about 325° F.; a light cycle oil end point (D-1186) in the range of from about 600° to about 650° F.; a heavy cycle oil draw temperature in the range of from about 600° to about 690° F.; a heavy cycle oil initial boiling point (D-1186) in the range of from about 470° to about 500° F.; and a heavy cycle oil end point (D-1186) in the range of from about 960° to about 990° F.

One of the most serious and commonly encountered problems in delayed coking operations is foamover. Foamover typically results from the formation of an excessive volume of foam in the live coking drum during the fill cycle. When foamover occurs, partially coked resid is carried into the coke drum overhead line and, depending on the amount of such overflow, can result in: coke lay-down in the coke drum overhead lines; partial plugging of the combination tower bottoms screen; complete plugging of the combination tower bottom screen and a resultant sudden loss of feed to the coker heater; plugged (i.e., coked) heater tubes resulting from the sudden loss of flow therethrough; and plugging of the coker blowdown system. A massive foamover can even carry coke into the upper portions of the combination tower.

Foam is primarily formed from waxy, paraffinic condensed hydrocarbons present in the live coking drum during the fill cycle. A primary source of such material comprises condensate which forms in the live drum when hot resid is first switched into the drum at the beginning of the fill cycle. Although the empty drum is warmed prior to beginning the fill cycle, the warmed drum will typically still be very cool compared to the hot resid material flowing from the coker heater. Thus, some of the vapor condenses, particularly on the interior surface of the coking drum.

Each barrel of the condensed hydrocarbon material can form up to 1,200 barrels of foam in the live drum. The foam material travels up the coking drum on top of the coke layer.

Several factors promote the formation and expansion of foam material within the filling drum. These include: the amount of condensed and/or entrained liquid hydrocarbon material present in the drum; pressure swings in the live coking drum; a significant drop in overhead vapor product temperature; failure of the anti-foam chemical addition system; and over-filling the live drum. Particularly significant pressure losses typically occur in the live drum when a portion of the vapor product therefrom is diverted to warm up an empty drum.

Besides causing foam problems, condensate remaining or formed in the drum during the fill cycle detrimentally affects the quality and value of the coke product. Coke containing a significant amount of condensate material is commonly referred to as "sticky" or "green" coke.

The procedures heretofore used in the art for preventing foamovers have commonly included: attempting to ensure that the unit operators drain completely the warm, empty coking drum before beginning the fill cycle; injecting silicone anti-foam chemicals when a high foam level is detected in the live drum; restricting the fill rate so that the final level of the coke product is significantly below the top of the coking drum; and significantly limiting the amount of warm-up vapor taken from the live drum.

These approaches for reducing foam formation and expansion have serious shortcomings and are typically highly susceptible to operator error. Restricting fill rates and product levels significantly reduces unit capacity and, by necessitating the use of larger drums and/or a greater number of drums to achieve a given capacity, significantly increases construction costs. Silicone anti-foam chemicals are costly, unreliable, and can significantly poison catalysts used in fluid catalytic crackers and other downstream processing systems.

Most significantly, attempting to maintain live drum pressure by reducing the amount of warm-up vapor taken from the live drum can result in the empty drum being not sufficiently warmed before beginning the fill cycle. Foam formation rates increase rapidly with decreasing switchover temperatures, particularly below 600° F. Unfortunately, however, due to the inadequacy of the warm-up procedures heretofore used in the art, switchover temperatures of as little as 450° F. or less are common. Low switchover temperatures can also produce large pressure and temperature losses at the beginning of the fill cycle.

Due to the fact that the coking drum product vapor constitutes the primary feed to the coking unit fractionator, the fractionator is also adversely affected by pressure, temperature, and product flow fluctuations in the coking drum. Such changes can easily upset the operation of the fractionator and thus have a deleterious effect on the consistency and quality of the product fractions drawn from the fractionator.

In addition to these problems, a need also exists for a cost effective and efficient approach for significantly reducing warm-up vapor temperature and pressure losses during the drum warming process. In the coking units heretofore known in the art, the design and structure of the drum overhead systems have focused almost exclusively on the delivery of cracked vapor from the coking drums to the fractionator. It has been the practice of those skilled in the art to then conduct the drum warming procedure by diverting a portion of the product vapor from the live drum (i.e., the warm-up vapor) such that it simply travels in reverse flow through the overhead system to the top of the cold drum. As a result, the warm-up vapor has been required to travel a total of more than (typically much more than) 250 feet from the top of the live drum to the top of the cold drum. Even with the use of highly insulated piping, the temperature of the warm-up vapor will commonly decrease by as much as 90° F. or more by the time it reaches the cold drum. Moreover, as a result of such temperature loss coupled with frictional losses and condensation, the motive pressure of the warm-up vapor will commonly decline by as much as 10 psi or more by the time it reaches the cold drum. These losses in temperature and motive pressure undesirably prolong the warming process and significantly reduce the switchover temperatures obtainable.

SUMMARY OF THE INVENTION

The present invention satisfies the needs and alleviates the problems discussed hereinabove by providing an improved method of producing petroleum coke in a petroleum coking system of the type having at least a pair of coking drums operating in a cyclical manner such that, when a first coking drum is being operated in a fill cycle wherein a coker feed material flows into the first coking drum to form coke and produce a vapor product, a second coking drum is operated in a second cycle including a warning stage wherein a flow of warm-up vapor comprising a portion of the vapor product is delivered through the second coking drum.

In one aspect, the inventive improvement comprises the steps of: (a) adding a fluid to the first coking drum during the warming stage effective for providing additional vapor in the first coking drum, the fluid being a material other than the coker feed material and (b) reducing pressure loss in the first coking drum during the warming stage by regulating the addition of the fluid to the first coking drum based upon a target pressure for the first coking drum and by regulating the flow of warm-up vapor from the first coking drum to the second coking drum based upon a target pressure for the second coking drum. In a particularly preferred embodiment of the invention, an actual pressure is determined for the first coking drum and the target pressure in the second coking drum is said actual pressure minus a targeted pressure differential.

In another aspect of the inventive method, the first coking drum has an upper end portion, the second coking drum has an upper end portion, and the improvement comprises conducting the flow of warm-up vapor from the upper end portion of the first coking drum to the upper end portion of the second coking drum via conduit means having a total length of less than 100 feet. Such conduit means will preferably have a total length of less than 75 feet.

Further aspects, features, and advantages of the present invention will be apparent to those skilled in the art upon examining the accompanying drawing and upon reading the following detailed description of the preferred embodiments.

BRIEF DESCRIPTION OF THE DRAWING

The drawing schematically illustrates a preferred embodiment of the present invention.

DETAILED DESCRIPTION OF THE PREFERRED EMBODIMENTS

The drawing provides a schematic illustration of the present invention as employed in a common type of delayed coking system. Crude vacuum resid and/or other heavy coker feed material flows through conduit 1 to the bottom portion of fractionator 10. In the bottom of fractionator 10, heavy fractionator bottoms liquid (recycle) combines with the coker feed. The resulting heavy liquid material is pumped via conduit 2 through coker heater 29. The hot material then flows through conduit 3 to switch valve 28.

The coking system depicted in the drawing includes two vertical coking drums 25 and 26. Drums 25 and 26 are operated on alternating cycles such that, when one drum (i.e., the live drum) is operating in the fill cycle, the other drum is operating in the de-coking and preparation cycle. The de-coking and preparation cycle typically includes a sequence of operations including: a steaming stage; a cooling/quenching stage; a hydraulic de-coking stage; a pressure testing stage; and a warm-up stage. If drum 25 is operating in the fill cycle, valve 24 is closed and switch valve 28 diverts the hot feed material to the bottom of drum 25 via conduit 4. However, if drum 26 is operating in the fill cycle, valve 29 is closed and switch valve 28 diverts the hot feed material to the bottom of drum 26 via conduit 5. Assuming that drum 25 is operating in the fill cycle, drum 26 overhead valve 9 will be closed and drum 25 overhead valve 8 will be open such that the vapor produced in live drum 25 will flow to fractionator 10 via lines 6, 11, and 13.

Although in much of the discussion which follows, drum 25 is referred to as being the live drum and drum 26 is referred to as the cold drum, it will be understood that, in alternating cycles, the operation of the drums will be reversed. In addition, although two coking drums 25 and 26 are shown in FIG. 1, it will be understood that the inventive method described herein can also be employed in coking systems having more than two coking drums.

Fractionator 10 will preferably include typical pump-around and condensing systems (not shown) for fractionating the vapor product. Typical products provided by the fractionator will include: an overhead cracked gas (e.g., fuel gas) product 30; an overhead gasoline/naphtha distillate product 31; a light cycle oil side draw product 32; and a heavy cycle oil side draw product 33. As indicated above, various names are used in the art to identify the light and heavy cycle oil products. The names "light cycle oil" and "heavy cycle oil" used herein and in the claims refer to and encompass all such products.

As will be understood by those skilled in the art, the operating conditions employed in the coking system can vary substantially depending upon: the specific coker feed used; desired product specifications; desired product make; unit design; etc. Generally any desired conditions and parameters can be used when employing the present invention.

For purposes of illustration, and without in any way limiting the scope of the present invention, one common set of operating parameters, and the results obtained in an existing coking system without benefit of the present invention, might include: a live drum bottom temperature of about 900° F.; a live drum overhead temperature varying during the fill cycle between about 800° and about 820° F.; a live drum overhead pressure fluctuating between about 23 and about 34 psig; and a cold drum (pre-warm-up) temperature of from about 200 to about 250° F. For the first three to four hours after switching to the fill cycle, the live drum pressure will typically drop by an amount in the range of from about 5 to about 10 psig. The pressure also typically fluctuates substantially during the latter half of the fill cycle, particularly during the period in which vapor from the live drum is used to warm up an empty drum. During the warm-up stage, the pressure at the top of the live drum will typically drop by an amount in the range of from about 3 to 5 psig and the temperature at the top of the live drum will typically drop by an amount in the range of from about 10 to about 20° F.

Pressure losses in the live drum, particularly during the initial and warm-up stages of the fill cycle, result in a higher vapor velocity within the drum and thus cause a substantial increase in foam production and expansion. Significant temperature losses typically occurring during these periods further contribute to foam production and expansion. By the end of the fill cycle, the formation of a foam front of up to 30 feet and more above the coke layer has not been unusual.

In one aspect of the present invention, a fluid is added to the live coking drum in a manner and in an amount effective for reducing pressure swings within the live coking drum. The fluid is preferably injected into the upper portion of the coking drum through the side wall or through the upper head of the drum. As employed in the present invention, the injected fluid preferably increases the amount of vapor formed in the live drum and thus operates to increase the pressure within the live drum and thereby compensate for pressure losses. The injected fluid also acts to provide additional vapor for warming the cold drum. Most preferably, the fluid is added in a manner and amount effective for maintaining a substantially constant pressure in the live drum.

Although preferably employed throughout the fill cycle, the addition of fluid in accordance with the present invention can be selectively employed in the live drum during (a) the initial stage of the fill cycle (preferably during at least the first three to four hours of the fill cycle), (b) the empty drum warm-up stage of the fill cycle, (c) the latter half of the fill cycle, and/or (d) any other portion of the fill cycle. When initiated in a latter portion of the fill cycle, the present invention also operates to significantly collapse the foam front formed during the previous portion of the cycle. Such fluid addition will preferably be conducted during at least the cold drum warm-up stage.

Examples of suitable injection materials include: steam; water; hydrocarbon liquids which will either completely vaporize in the live drum or will vaporize at least to an extent sufficient to add pressure to the coking drum; and hydrocarbon vapor. The fluid will preferably be a coker fractionator side draw or overhead product. The fluid will more preferably be light cycle oil, heavy cycle oil, or a combination thereof. The fluid will most preferably be heavy cycle oil. In most commercial coking units, a light cycle oil and/or heavy cycle oil injection rate of from about 40 to about 70 gallons per minute will be sufficient to maintain a substantially constant, or at least much more stable, overhead pressure in the coking drum throughout the fill cycle.

Any coker products employed for reducing pressure swings in the live drum are simply re-recovered in the coker fractionator and are therefore particularly well suited for use in accordance with the present invention. Heavier coker product fractions are less volatile than lighter fractions and therefore provide a more stable pressure control medium. Heavier fractions can also be delivered to the coking drum at higher temperatures such that, at typical injection rates, they will not significantly decrease the coking drum overhead temperature. Maintaining a higher coking drum overhead temperature reduces foam production and expansion and facilitates the attainment of higher warm-up temperatures.

Depending upon whether the light and/or heavy cycle oil material is obtained (a) directly from the fractionator, (b) after stripping, or (c) after cooling/heat exchange, the material will typically be injected into the live drum at a temperature in the range of from about 150° to about 690° F., preferably from about 450° to about 690° F. Most preferably, heavy cycle oil will be injected into the live drum at a temperature in the range of from about 600° to about 690° F.

As illustrated in the drawing, valves 36 and 37 can be opened or closed as desired to deliver a light cycle oil and/or heavy cycle oil slip stream to coker drums 25 and 26. Valves 18 and 19, provided in lines 16 and 17, respectively, can be opened and closed as necessary to direct the injection material to the particular drum 25 or 26 operating in the fill cycle. The light and/or heavy cycle oil injection material is delivered to lines 16 and 17 via conduits 36 and/or 37 and conduit 14. A valve 15 is provided in conduit 14 for controlling the rate at which the material is injected into the live drum 25 or 26. Valve 15 can be operated manually to maintain a substantially constant, or at least more stable, pressure within the live drum. Most preferably, pressure transmitters 40 and 44 and pressure controller 45 are provided for automatically controlling valve 15 based on the live drum pressure such that valve 15 opens as the pressure in the live drum decreases. The set (target) pressure in the live drum will typically be in the range of from about 22 to about 40 psig. The set pressure will preferably be in the range of from about 25 to about 35 psig and will most preferably be about 30 psig. The live drum pressure will preferably be measured either directly in the top of the drum 25 or 26 or at least close to the top of the drum in line 6 or 7.

In another aspect of the present invention, the coking system has also been improved by the addition of a special warm-up vapor flow line 46 extending between the upper ends of drums 25 and 26. The new warm-up line 46 has a warm-up vapor control valve 48 positioned therein. The respective ends of new line 46 can be installed directly in the tops of drums 25 and 26 or can be tied into the existing overhead lines 6 and 7 extending from drums 25 and 26. If tied into existing lines 6 and 7, the location of the respective connections will preferably each be at a total flow length of less than 10 feet from the top of drum 25 or drum 26. Moreover, new line 46 will preferably be positioned and oriented such that the total flow path of the warm-up vapor between the tops of drums 25 and 26 will be less than 100 feet. The total flow path of the warm-up vapor between the tops of drums 25 and 26 will more preferably be less than 75 feet and will most preferably be less than 60 feet. As will also be understood by those skilled in the art, new line 46 will preferably be insulated such that temperature losses from the warm-up vapor are minimized.

In accordance with the present invention, by delivering all of the warm-up vapor through new line 46, temperature losses of less than 50° F. and typically less than 40° F. can be achieved. Moreover, the length and orientation of new line 46 will most preferably be such as to ensure that a temperature loss of less than 35° F. is achieved. Reducing temperature loss in this manner and minimizing the total length of the warm-up vapor flow path between drums 25 and 26 also significantly preserves the motive pressure of the warm-up vapor such that the pressure of the vapor entering cold drum 26 will be not more than 7 psig less than the pressure of the vapor exiting the top of live drum 25. The pressure of the warm-up vapor entering the top of cold drum 26 will more preferably be not more than 5.5 psig less than the pressure at the top of live drum 25 and will most preferably be not more than 4 psig less than the pressure at the top of live drum 25.

When drum 26 reaches the warm-up stage of the second operating cycle, overhead valve 48 is opened such that a portion of the vapor product produced in live drum 25 flows into the top of drum 26 via line 7. Valves 29 and 27 are also opened such that the warm-up vapor flows downward through drum 26 and then into condensate drum 20 via line 23. Condensate produced in the warm-up process collects in condensate drum 20 and is removed via conduit 21. The non-condensed warm-up material flows from condensate drum 20 to vapor product line 13 via line 26. The non-condensed warm-up material then flows with the remaining overhead product vapor into fractionator 10.

In a particularly preferred aspect of the present invention, the pressure in live drum 25 during the warm-up stage is further stabilized and maintained by regulating the flow of warm-up vapor based upon the pressure in cold drum 26. The targeted pressure in cold drum 26 during the warm-up stage will typically be in the range of from about 20 to about 35 psig and will preferably be in the range of from about 24 to about 35 psig.

In a particularly preferred embodiment of the present invention, a pressure ratio controller 43 or other device is used during the warm-up stage to control the delivery of warm-up vapor to cold drum 26 based upon a targeted pressure differential in cold drum 26 relative to the actual pressure in the live drum 25. The targeted differential will preferably be in the range of from about 3 to about 10 psi. Thus, for example, if pressure transmitter 40 indicates that the overhead pressure in live drum 25 is 30 psig and the targeted pressure differential in cold drum 26 is 5 psi, the pressure ratio controller 43 will operate the warm-up vapor control valve 48 in a manner effective to achieve and maintain a cold drum pressure 44 of 25 psig.

The pressurizing fluid valve 15, pressure controller 45, and other equipment employed in the inventive system will preferably be of sufficient responsiveness and reliability that it will not be necessary to change the set pressure for the live drum at any point during the filling operation. Thus, for example, if the targeted overhead pressure in the live drum is 30 psig, the valve 15, controller 45, and other associated equipment will preferably be effective for regulating the flow of pressurizing fluid to the live drum such that sufficient warm-up vapor is provided to the cold drum while maintaining a live drum overhead pressure of, or at least very close to, 30 psig. However, in an alternative aspect of the present invention, if the fluid valve 15, controller 45, and associated equipment are for some reason inadequate to prevent a pressure reduction of 1 psig or more in the live drum during the warm-up stage, the set pressure of controller 45 can be temporarily increased during the warm-up stage by an amount such that valve 15 provides additional fluid to the live drum for pressurization and warm-up.

Controlling the pressures of both the live drum and the cold drum during the warming process in the manner provided by the present invention operates to further decrease foam formation and expansion in the coking drums by preventing significant depressurization of the live drum during the warm-up operation and by providing a significantly higher empty drum temperature and pressure at the beginning of the fill cycle.

The inventive system thus stabilizes the live drum pressure and minimizes foam production and expansion. With more stable pressure conditions, vapor velocity within the live drum will be substantially constant. The inventive system also operates to provide additional hot vapor material for warming the empty drum. Further, the inventive system operates to more effectively preserve the temperature and motive pressure of the warm-up vapor. Thus, a drum switchover temperature of 650° F. can be consistently achieved. Moreover, the desired warm-up temperature is achieved in a shorter period of time.

When using the present invention, the foam front formed in the live drum will typically only be in the range of from about 1 to about 5 feet deep. Thus, by eliminating up to 25+ feet of foam, the present invention also substantially increases the available capacity of the coking system.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In a method of producing petroleum coke in a petroleum coking system having at least a pair of coking drums operating in a cyclical manner such that, when a first coking drum is being operated in a fill cycle wherein a coker feed material flows into said first coking drum to form coke and produce a vapor product, a second cooking drum is operated in a second cycle including a warming stage wherein a flow of warm-up vapor comprising a portion of said vapor product is delivered into said second coking drum, the improvement comprising the steps of:

(a) adding a fluid to said first coking drum during said warming stage effective for providing additional vapor in said first coking drum, said fluid being a material other than said coker feed material and (b) reducing pressure loss in said first coking drum during said warming stage by regulating the addition of said fluid to said first coking drum based upon a target pressure for said first coking drum and by regulating said flow of warm-up vapor from said first coking drum to said second coking drum based upon a target pressure for said second coking drum.

2. The method of claim 1 wherein an actual pressure is determined for said first coking drum and said target pressure in said second coking drum is said actual pressure minus a targeted pressure differential.

3. The method of claim 2 wherein said targeted pressure differential is in the range of from about 2 psi to about 12 psi.

4. The method of claim 3 wherein said pressure differential is in the range of from about 3 psi to about 10 psi.

5. The method of claim 3 wherein said target pressure for said first coking drum is in the range of from about 25 psig to about 40 psig.

6. The method of claim 1 wherein:

said petroleum coking system further includes a fractionator for fractionating said vapor product produced in said first coking drum;

said fractionator produces cycle oil and at least one light product having an end point temperature below that of said cycle oil; and said fluid comprises at least a portion of said light product, at least a portion of said cycle oil, or a combination thereof.

7. The method of claim 1 wherein:

said petroleum coking system further includes a fractionator for fractionating said vapor product produced in said first coking drum;

said fractionator produces a light coker cycle oil product and a heavy coker cycle oil product; and said fluid comprises at least a portion of said light coker cycle oil product, at least a portion of said heavy coker cycle oil product, or a combination thereof.

8. The method of claim 7 wherein said fluid is at least a portion of said heavy coker cycle oil product.

9. The method of claim 7 wherein said fluid is delivered from said fractionator to said first coking drum without heating.

10. The method of claim 7 wherein said fluid is delivered to said first coking drum at a temperature in the range of from about 450° to about 690° F.

11. The method of claim 7 wherein said fluid has a D-1186 end point of not more than 990° F.

12. The method of claim 1 wherein said coker feed material flows into a lower end portion of said first coking drum and said fluid is delivered into an upper end portion of said first coking drum.

13. The method of claim 1 wherein:

said first coking drum has an upper end portion;

said second coking drum has an upper end portion; and the improvement further comprises conducting said flow of warm-up vapor from said upper end portion of said first coking drum to said upper end portion of said second coking drum via conduit means having a total length of less than 100 feet.

14. The method of claim 13 wherein said total length of said conduit means is less than 75 feet.

15. In a method of producing petroleum coke in a petroleum coking system having at least a pair of coking drums operating in a cyclical manner such that, when a first coking drum is being operated in a fill cycle wherein a coker feed material flows into said first coking drum to form coke and produce a vapor product, a second coking drum is operated in a second cycle including a warming stage wherein a flow of warm-up vapor comprising a portion of said vapor product is delivered into said second coking drum, said first coking drum having an upper end portion and said second coking drum having an upper end portion, the improvement comprising conducting said flow of warm-up vapor from said upper end portion of said first coking drum to said upper end portion of said second coking drum via conduit means having a total length of less than 100 feet.

16. The method of claim 15 wherein said total length of said conduit means is less than 75 feet.

17. The method of claim 15 wherein the improvement further comprises regulating said flow of warm-up vapor from said first coking drum to said second coking drum based upon a target pressure for said second coking drum.

18. The method of claim 17 wherein an actual pressure is determined for said first coking drum and said target pressure in said second coking drum is said actual pressure minus a targeted pressure differential.

19. The method of claim 18 wherein targeted pressure differential is in the range of from about 2 psi to about 12 psi.

20. The method of claim 18 wherein said targeted pressure differential is in the range of from about 3 psi to about 10 psi.

* * * * *